US006736652B1

(12) United States Patent
Slough

(10) Patent No.: US 6,736,652 B1
(45) Date of Patent: May 18, 2004

(54) ELECTRICAL PLUG LOCK OUT APPARATUS AND METHOD

(76) Inventor: David Slough, Rte. 2, Box 2367, Elkhart, TX (US) 75839

( * ) Notice: Subject to any disclaimer, the term of this patent is extended or adjusted under 35 U.S.C. 154(b) by 0 days.

(21) Appl. No.: 10/104,444

(22) Filed: Mar. 25, 2002

(51) Int. Cl.[7] ..... H01R 13/44
(52) U.S. Cl. ..... 439/133; 70/230
(58) Field of Search ..... 439/133–134, 439/304, 359, 362, 346, 306, 338, 339, 368, 372, 801, 805, 870, 874; 70/229, 230, 232

(56) References Cited

U.S. PATENT DOCUMENTS 3,360,763 A * 12/1967 Rongey et al. ..... 439/14
3,782,146 A * 1/1974 Franke ..... 70/163
3,784,959 A * 1/1974 Horton ..... 439/60 M
4,302,066 A * 11/1981 Newman et al. ..... 439/82
4,598,964 A * 7/1986 Frink et al. ..... 439/37
4,721,475 A * 1/1988 Burke, Jr. ..... 439/133

* cited by examiner

*Primary Examiner*—Ross Gushi
*Assistant Examiner*—Phuongchi Nguyen
(74) *Attorney, Agent, or Firm*—Harrison & Egbert

(57) ABSTRACT

A lock out apparatus including a plug having an electrical line extending therefrom and a generally tubular nose portion, a tubular body having an interior passageway removably receiving the nose portion of the plug therein, and a set screw extending through a wall of the tubular body so as to be rotatably movable between a first position exerting a compressive force against the nose portion and a second position releasing the nose portion. An arm is pivotally connected to the set screw and is movable between a first position preventing rotation of the set screw and a second position allowing rotational movement. A post is affixed to the tubular body and includes a slot which is suitable for receiving the arm in the first position. A lock can extend through an aperture of the arm and through holes in the post so as to fix the arm within the slot of the post.

10 Claims, 2 Drawing Sheets

ELECTRICAL PLUG LOCK OUT APPARATUS AND METHOD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to methods for preventing the establishment of an electrical connection between a plug and a socket. More particularly, the present invention relates to lock out devices for use with pin-and-sleeve connectors.

BACKGROUND OF THE INVENTION

Pin-and-sleeve types of electrical connectors have been developed for a variety of special applications and have proven to be extremely useful and advantageous for a number of reasons. The descriptive name for this type of connector is derived from the construction of the male and female connector portion wherein the electrical contacts in the male part, or plug, are two or more cylindrical, solid, electrically conductive pins which are mounted in the body of the plug and the contacts in the female part, or receptacle, are a corresponding number of electrically conductive sleeves. The pins and the plug are surrounded by a substantially cylindrical protective shroud. The receptacle portion of such connector includes a generally cylindrical insulating inner body having tubular recesses with the elongated conductive sleeves to receive the pins and a shell which is spaced from the insulating body, leaving an annular gap to receive the shroud. The shroud and shell are provided, respectively, with a key and slot so that the orientation of the shroud with respect to the shell, and with respect to the pin-receiving body of the receptacle is easily established.

Additionally, the ground portion of plug portion of the connector is always larger in diameter than the other pins and the conductive sleeve to receive the ground pin in the receptacle body not only is suitably sized to receive the pin but also reaches further toward the open end of the body than the conductive sleeves adapted to receive the other pins, thereby permitting a ground connection to be established before any other connection is made.

Pin-and-sleeve connectors have numerous advantages including the fact that the pin arrangements can be made in a variety of configurations, each configuration being unique to a particular set of voltage, phase and current characteristics. The shroud, as mentioned above, protects the pins from damage and protects the user from accidental contact with the pins. Normally, the receptacle carries the power which is supplied to the plug. Thus, the shroud enters the annular cavity and the receptacle before power is provided to the pins, providing a further safety measure. The shroud construction tends to exclude foreign materials and the overall construction has been found to be highly durable and reliable.

A persistent problem associated with the use of such pin-and-sleeve connectors is that these connectors are often used in very large-scale industrial applications. As a result, an extraordinary length of electrical line can extend from the source of electricity to the device that utilizes the electricity. Often, workmen must work on machines, motors and other electrical devices a considerable distance from the actual plug connections. Under certain circumstances, workers will see that a plug has not been connected into the receptacle and attempt to correct this problem. Persons at the work site may be unaware of the fact that the machine or motor at the other end of the electrical line is being repaired. As a result, the electrician can often suffer a fatal shock from this plugging of the plug into the socket. As such, it is important to prevent such inadvertent connections of the plug into the receptacle. Conventionally, devices that are used to prevent accidental connections between a plug and a socket are called "lock out" devices. These types of devices are described in various U.S. patents. For example, U.S. Pat. No. 6,220,885, issued on Apr. 24, 2001 to Lemberger, describes a safety locking system including slide bolts for preventing accidental connection.

U.S. Pat. No. 4,957,446, issued on Sep. 18, 1990 to R. R. Belsky, describes a lock out device which includes a securing means which prevents the removal of prongs from the housing so as to prevent unrestricted use of the electrical plug. U.S. Pat. No. 5,281,162, issued on Jan. 25, 1994 to N. E. Ursich, describes a self-locking female receptacle for an electrical cord. U.S. Pat. No. 5,073,122, issued on Dec. 17, 1991 to R. A. Burke, Jr., describes a lock-out enclosure for power connectors. The enclosure is moveable along the electrical line to a position enclosing the power connector. U.S. Pat. No. 5,055,057, issued on Oct. 8, 1991 to P. L. Boyer, describes a locking device for attachment to the male electrical plug of a power supply. None of these prior art patents are particularly adapted for use in conjunction with the pin-and-sleeve types of connectors.

It is an object of the present invention to provide a lock out device which prevents the inadvertent connection of the plug into the receptacle.

It is another object of the present invention to provide a lock out device which effectively prevents electrical shock injuries to workers located at a distance from the power receptacle.

It is a further object of the present invention to provide a lock out device that can be easily applied to a plug of a pin-and-sleeve connector.

It is a further object of the present invention to provide a lock out device which is easy to use, relatively inexpensive and easy to manufacture.

These and other objects and advantages of the present invention will become apparent from a reading of the attached specification and appended claims.

BRIEF SUMMARY OF THE INVENTION

The present invention is a lock out apparatus comprising a plug having an electrical line extending therefrom and a tubular nose portion, a tubular body having an interior passageway and an exterior surface in which the interior passageway removably receives the nose portion of the plug therein, and a set screw extending through a wall of the tubular body and rotatably movable between a first position exerting a compressive force against the nose portion and a second position releasing the nose portion.

The tubular has a threaded hole formed through a wall thereof The set screw is threadedly received within this threaded hole. The set screw has a surface extending outwardly of the exterior surface of the tubular body. An arm is pivotally connected to this surface of the set screw. The arm is movable to a first position preventing rotational movement of the set screw and to a second position allowing rotational movement of the set screw. A post is affixed to the tubular body and extends outwardly of the exterior surface of the tubular body. The post has a slot formed therein. This slot receives the arm in the first position. The post has a hole extending therethrough on opposite sides of the slot. The arm has an aperture formed therein which is coincident with the hole of the post when the arm is in the first position. A rigid member extends through the hole of the post and the aperture of the arm. In the preferred embodiment of the present invention, the rigid member is a padlock.

The present invention is also a method of preventing a connection between a plug and a an electricity-providing receptacle including the steps of forming a tubular body having an interior passageway slightly larger than the exterior diameter of the nose portion; (2) sliding the tubular body over the nose portion such that the nose portion resides within the interior passageway; and (3) rotating the set screw such that a surface of the set screw compressively contacts the nose portion of the plug.

In the method of the present invention, there is also provided the step of pivoting an arm extending outwardly of the set screw downwardly so that a portion of the arm resides within the slot of the post. The aperture of the arm is aligned with the holes in the post, and then a rigid member to is inserted through the hole and the aperture. The present invention also includes the steps of inserting a ring of the padlock through the hole and the aperture, and then locking the ring into the body of the padlock.

DETAILED DESCRIPTION OF THE INVENTION

Figure 1:
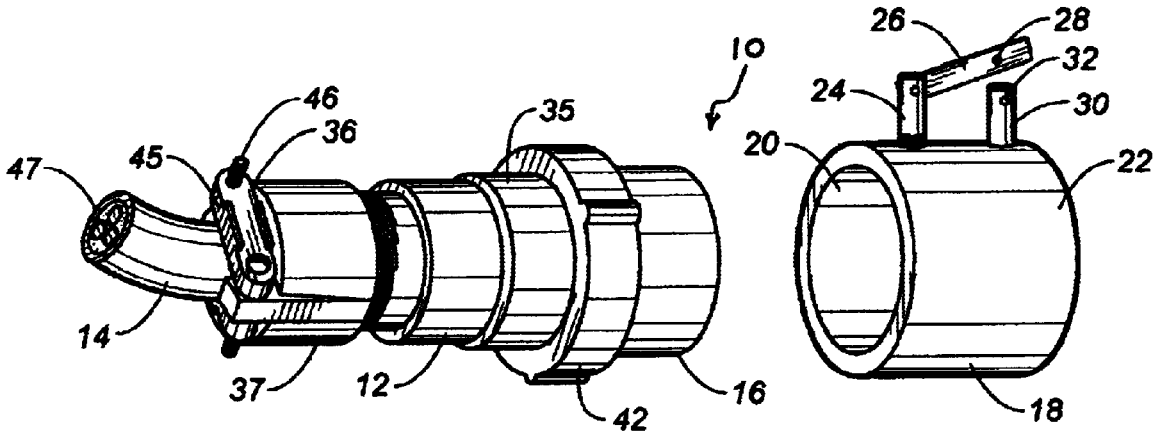
FIG. 1 is an exploded view showing the lock out apparatus of the present invention.

Referring to FIG. 1, there is shown the lock out apparatus 10 in accordance with the teachings of the present invention. The lock out apparatus 10 includes a plug 12 having an electrical line 14 extending therefrom. The plug 12 includes a generally tubular nose portion 16 having an exterior surface. The lock out apparatus 10 of the present invention also includes a tubular body 18 having an interior passageway 20 and an exterior surface 22. The interior passageway 20 of the tubular body 18 removably receives the nose portion 16 of the plug 12. A set screw 24 extends through a wall of the tubular body 18. The set screw 24 is rotatably movable between a first position exerting a compressive force against the nose portion 16 of the plug 12 and a second position releasing the nose portion 16. An arm 26 is pivotally connected to the set screw 24 and extends outwardly therefrom. The arm 26 has an aperture 28 formed at an end of the arm 26 opposite the set screw 24. A post 30 extends upwardly from the exterior surface 22 of the tubular body 18. Set screw 30 also includes a hole 32 extending transversely through the post 30. In FIG. 1, the set screw 24 and the arm 26 are in their position which allows the interior passageway 20 to be slidably positioned over the nose portion 16 of the plug 12.

The plug 12 includes a housing 34 having the nose portion 36 which will mate with the receptacle of a pin-and-sleeve type of connector. The plug 10 also includes a rear end 37. The nose portion 16 is of a tubular shape and protectively surrounds a plurality of plug terminals that project forwardly therefrom. The tubular front end 35 of the plug 12 is conventionally of a size that will axially slide into the annular gap in a power-providing receptacle. The plug also conventionally includes a loose collar 42 that is internally threaded for engagement with the threads associated with a receptacle. The rear end 36 of the plug conventionally carries a clamp 45 along with tightening screws 46 for securely clamping a multi-conducting cable 47 (within electrical line 14) thereto. In FIG. 1, there is shown a pin-and-sleeve connector plug of a type manufactured by Appleton Electric Company. It is to be noted, however, that the lock out device of the present invention, can be also applied to a wide variety of other such plugs. Generally, the concept of the present invention can be applied to any such plugs which include a generally tubular nose portion 16.

Figure 2:
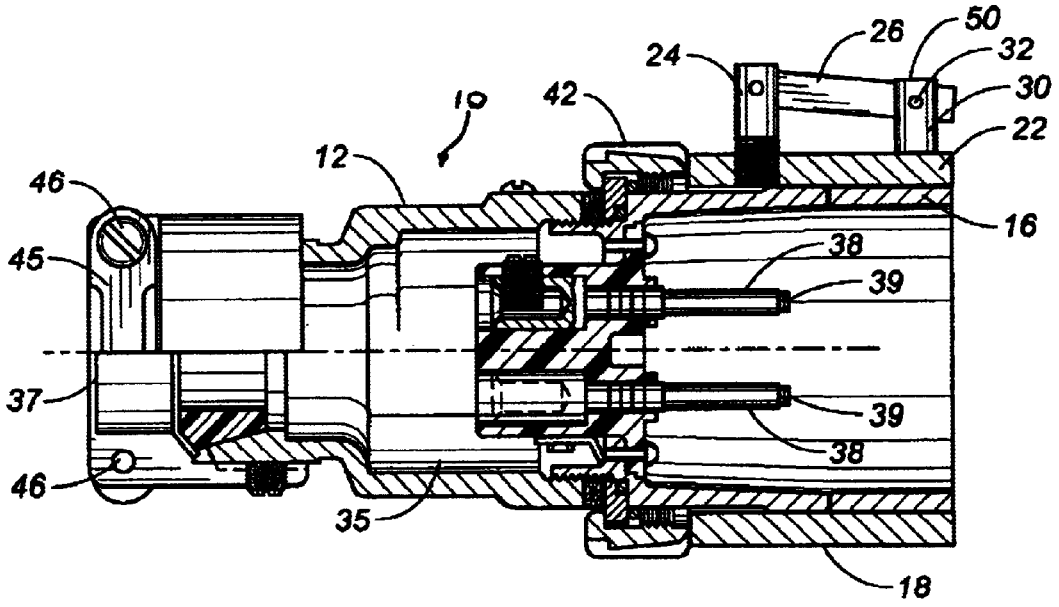
FIG. 2 is a cross-sectional view showing the lock out device of the present invention as applied to a nose portion of a plug.

FIG. 2 illustrates the application of the tubular body 18 around the exterior surface of the nose portion 16 of plug 12. In FIG. 2, it can be seen that the plug terminals 38 project forwardly from the body of the plug 12 such that their distal ends carry butt contacts 39 thereon of a suitable contact material, such as silver cadnium oxide. As can be seen, the terminals 38 are protectively maintained within the interior of the tubular nose portion 16.

The tubular nose portion 16 is slidably received within the interior passageway 12 of the tubular body 18. Once in this position, the arm 26 can be suitably manipulated so as to tighten the set screw 24 so that a surface of the set screw 24 within the interior passageway 30 of the tubular body 18 compressively contacts the exterior surface of the tubular nose portion 16. When a suitable compressive contact is established, the arm 26 can be lowered so as to enter a slot formed on the top 50 of the post 30. The aperture 28 of the arm 26 will align with the holes 32 associated with the post 30. As such, a rigid member can be placed into the holes 32 in the aperture 24 so as to prevent accidental release of the arm 26 from its locked position. In the position shown in FIG. 2, it is impossible for a person to inadvertently establish a connection between the plug 12 and the power-providing receptacle. Since the nose portion 16 must slide into the interior of the receptacle, the tubular body 18 prevents the connection from being established. The tubular body 18 will completely interfere with any effort to try and establish an electrical contact between the plug and the power-providing receptacle. The tightening of the set screw 24 upon the exterior surface of the nose portion 16 will keep the tubular body 18 from being removed from its locked position. This safety is further assured by the fact that the arm 26 is securely received within the slot of the post 30. Finally, a further preventive action can be taken by simply inserting the ring of a padlock through the aligned aperture 28 and holes 32 and then locking the padlock. Removal of the lock out device of the present invention is virtually assured in a wide variety of ways. The present invention provides primary, secondary and tertiary accident prevention. Because of the impossibility of connecting the plug 12 into the power-providing receptacle, electrical injuries at the other end of the electrical line 14 are effectively prevented.

Figure 3:
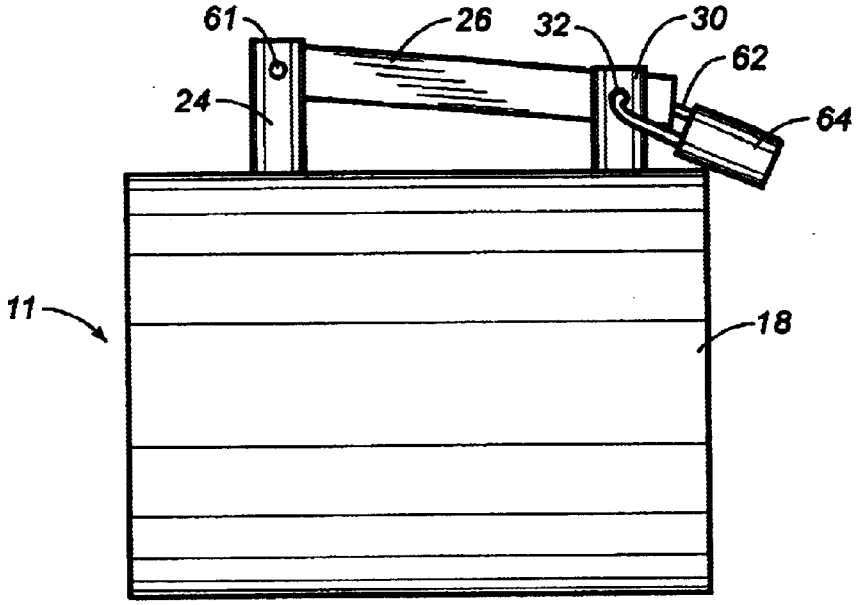
FIG. 3 is a side elevational view of the lock out device of the present invention.

FIG. 3 shows a side elevational view of the lock out device 11 of the present invention. As can be seen in FIG. 3, the lock out device 11 has generally tubular body 18 formed of a rigid steel material. The set screw 24 will extend through a wall of the tubular body 18 so as to have a surface exposed in the interior passageway 20 of the tubular body 18. The arm 26 is pivotally connected to the top of the set screw 24. A pivot pin 61 can be provided so as to allow the pivotal action of the arm 26 with respect to the set screw 24. The post 30 is provided with holes 32 extending transverse to the longitudinal axis of post 30. Post 30 can be threadedly received within the wall of the tubular body 18 or it can be welded thereto. The post 30 will have a slot formed at a top end thereof so that the arm 26 can be placed within the slot in its lowered position. As can be seen in FIG. 3, the aperture 28 of the arm 26 is aligned with the holes 32 of the post 30 so that the ring 62 of the padlock 64 can be inserted therethrough. In this position, it is impossible to release the tubular body 18 of the lock out device 11 from the tubular nose portion 16 of the plug 12.

Figure 4:
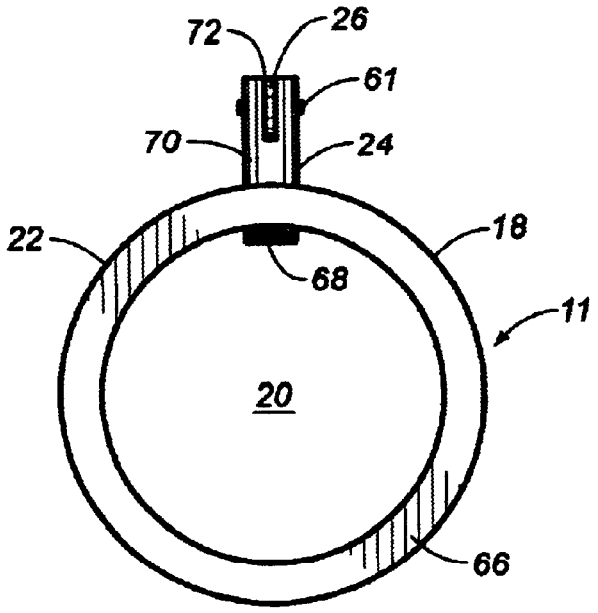
FIG. 4 is an end view of the lock out device of the present invention.

FIG. 4 shows an end view of the lock out device 11 of the present invention. FIG. 4 shows the tubular body 18 as having a wall 66 and an exterior surface 22. The interior diameter 68 of the interior passageway 20 is slightly larger than the outer diameter of the nose portion 16 of the plug 12. The set screw 24 has a surface 68 extending slightly into the interior passageway 20. Surface 68 will face the outer surface of the tubular nose portion. 16 of plug 12. The set screw 24 threadedly extends through the wall 66 so as to have an upper portion 70 extending outwardly of the exterior surface 22 of the tubular body 18. Arm 26 is pivotally received within a slot 72 formed at the top of the set screw 24. Pivot pin 61 is provided through the set screw 24 transverse to the longitudinal axis of the set screw 24 so as to facilitate the pivotal movement of the arm 26 with respect to the set screw 24.

Figure 5:
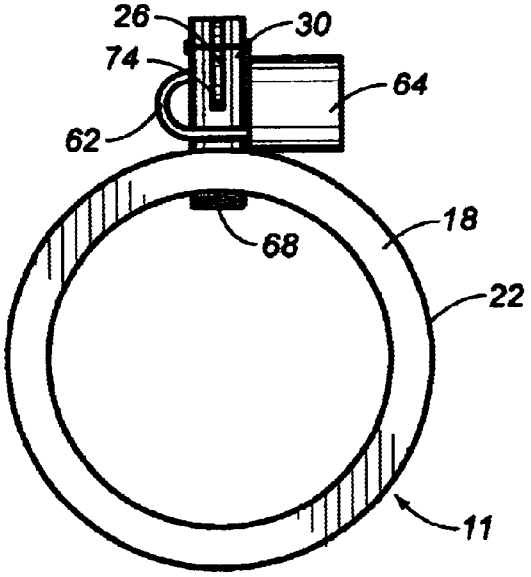
FIG. 5 is an opposite end view of the lock out device of the present invention.

FIG. 5 shows the opposite end of the lock out device 11 of the present invention. In FIG. 5, it can be seen that the post 30 extends upwardly from the outer surface 22 of the tubular body 18. Slot 74 is formed so as to extend downwardly from the top of the post 30. Slot 74 will have a suitable width so as to accommodate the thickness of the arm 26 therein. In FIG. 5, the aperture 28 of the am 26 is aligned with the holes 32 of the post 30 so that the ring 62 of padlock 64 can be inserted therethrough.

The foregoing disclosure and description of the invention is illustrative and explanatory thereof. Various changes in the details of the illustrated apparatus construction may be made within the scope of the appended claims without departing from the true spirit of the invention. The present invention should only be limited by the following claims and their legal equivalents.

I claim:

1. A lock out device for a plug connector comprising:

a tubular body having an interior passageway and an exterior surface;

a fixing means removably positioned on said tubular body so as to have a first portion extending outwardly of said exterior surface and a second portion extendable into said interior passageway, said fixing means for exerting a compressive force against a surface of the plug connector extending into said interior passageway, said fixing means comprising a set screw received within a threaded hole extending through said tubular body transverse to a longitudinal axis of said tubular body, said set screw being rotatable within said threaded hole so as to be movable from a position exerting the compressive force to a position releasing the compressive force, said set screw having a surface extending outwardly of said exterior surface of said tubular body;

a locking means connected to said fixing means for maintaining the compressive force exerted by said fixing means for a desired amount of time, said locking means comprising an arm pivotally connected to said surface of said set screw extending outwardly of said tubular body, said arm being movable to a first position preventing rotational movement of said set screw and a second position allowing rotational movement of said set screw; and a post affixed to said tubular body and extending outwardly from said exterior surface, said post having a slot formed therein, said slot receiving said arm in said first position.

2. The device of claim 1, said post having a longitudinal axis, said post having a hole extending therethrough transverse to said longitudinal axis and on opposite sides of said slot, said arm having an aperture formed therein coincident with said hole of said post when said arm is in said first position, said locking means comprising a rigid member extending through said hole of said post and said aperture of said arm.

3. The device of claim 2, said rigid member comprising a padlock.

4. A lock out apparatus comprising:

a plug having an electrical line extending therefrom, said plug having a generally tubular nose portion, said tubular nose portion having an exterior surface;

a tubular body having an interior passageway and an exterior surface, said interior passageway removably receiving said nose portion of said plug therein;

a set screw extending through a wall of said tubular body, said set screw being rotatably moveable between a first position exerting a compressive force against said nose portion and a second position releasing said nose portion, said tubular body having a threaded body formed through said wall thereof, said set screw threadedly received in said threaded hole, said set screw having a surface extending outwardly of said exterior surface of said tubular body;

an arm pivotally connected to a surface of said set screw extending outwardly of said tubular body, said arm being movable to a first position preventing rotational movement of said set screw and to a second position allowing rotational movement of said set screw; and a post affixed to said tubular body and extending outwardly of said exterior surface, said post having a slot formed therein, said slot receiving said arm in said first position.

5. The apparatus of claim 4, said plug having a plurality of pins extending interior of said nose portion.

6. The apparatus of claim 4, said post having a longitudinal axis, said post having a hole extending therethrough transverse to said longitudinal axis thereof and on opposite sides of said slot, the apparatus further comprising:

a rigid member extending through said hole of said post and said aperture of said arm.

7. The apparatus of claim 6, said rigid member being a padlock.

8. A method of preventing a connection between a plug and an electricity-providing receptacle, the plug having a generally tubular nose portion, the method comprising:

forming a tubular body having an interior passageway with an interior diameter slightly larger than an external diameter of said nose portion, said tubular body having a set screw extending through a wall thereof, said set screw having a portion extending outwardly of an exterior surface and a surface facing said interior passageway;

sliding said tubular body over said nose portion such that said nose portion resides within said interior passageway;

rotating said set screw such that said surface of said set screw compressively contacts said nose portion, said portion of said set screw extending outwardly of said exterior surface of said tubular body having an arm extending therefrom, said arm being pivotally connected thereto, said tubular body having a post extending outwardly of said exterior surface, said post having a slot in a top end thereof; and pivoting said arm downwardly such that a portion of said arm resides in said slot of said post.

9. The method of claim 8, said post having a hole formed therein on opposite sides of said slot, said arm having an aperture formed therein, the method further comprising:

aligning said arm in said slot of said post such that said aperture of said arm coincides with said hole of said post; and inserting a rigid member through said hole and said aperture.

10. The method of claim 9, said step of inserting a rigid member comprising:

inserting a ring of a padlock through said hole and said aperture; and locking said ring into a body of said padlock.

* * * * *